United States Patent [19]

Tudek

[11] 4,337,605

[45] Jul. 6, 1982

[54] CONCRETE BUILDING BLOCKS WITH LOOPED SECURING RODS FOR MORTARLESS WALL CONSTRUCTION

[76] Inventor: Arthur L. Tudek, 507 Indiana Ave., Glassport, Pa. 15045

[21] Appl. No.: 170,067

[22] Filed: Jul. 18, 1980

[51] Int. Cl.[3] ..... E04B 2/26

[52] U.S. Cl. ..... 52/293; 52/421; 52/428; 52/426; 52/747

[58] Field of Search ..... 52/293, 421, 426, 428, 52/432, 415, 565, 600, 687, 747

[56] References Cited

U.S. PATENT DOCUMENTS

| | | | |
|---|---|---|---|
| 1,726,903 | 9/1929 | Knight | 52/428 |
| 3,145,505 | 8/1964 | Cornelius | 52/428 X |
| 3,265,364 | 8/1966 | Frye | 52/293 X |
| 3,478,482 | 11/1969 | Weir | 52/293 X |
| 3,783,566 | 1/1974 | Nielson | 52/415 X |
| 3,881,289 | 5/1975 | Mauroner | 52/293 X |
| 4,091,587 | 5/1978 | Depka | 52/421 |
| 4,107,895 | 8/1978 | LeGrady | 52/426 X |
| 4,190,999 | 3/1980 | Hampton | 52/565 X |

FOREIGN PATENT DOCUMENTS

| | | | |
|---|---|---|---|
| 1124298 | 6/1956 | France | 52/428 |
| 186731 | 10/1922 | United Kingdom | 52/426 |

*Primary Examiner*—J. Karl Bell

[57] ABSTRACT

A generally rectangular concrete building block of partially hollow construction with at least one large rectangular vertical opening extending therethrough and provided with a generally zig-zag shaped rod embedded in the interior walls and extending transversely of and formed with a transverse loop in the center of each hollow interior. In erecting a wall, a concrete footing is first poured and a plastic sheet having a row of prepunched openings is flatly arranged thereon with the openings so spaced to indicate the positions to be assumed by a series of reinforcing bars when inserted therethrough and embedded within the footing to project vertically therethrough in a row alignable with the hollow blocks. After setting of the concrete the bars are securely anchored in the footing and enable the first course of blocks to be laid thereon with the openings therein and the centrally arranged loops embedded in each block sleeved over the bars so that the block and walls abut and their front surfaces are in alignment. Each successive course of blocks is correspondingly but staggerably arranged on and relative to those in the course below with their rod loops also sleeved over the bars until a mortarless wall of the required height is reached.

5 Claims, 7 Drawing Figures

CONCRETE BUILDING BLOCKS WITH LOOPED SECURING RODS FOR MORTARLESS WALL CONSTRUCTION

BRIEF SUMMARY OF THE INVENTION

This invention relates to generally rectangular building blocks of partially hollow construction having generally zig-zag shaped securing rods embedded in the interior walls and extending transversely of and formed with transverse loops in the centers of each hollow interior for locating and mounting the blocks over vertical reinforcing bars anchored in a footing for erecting a wall construction wherein the hollow blocks may or may not be filled with concrete.

CROSS REFERENCE TO PRIOR ART

While it has, of course, been common to use hollow building blocks with associated reinforcing rods in wall construction, such as those represented in U.S. Patents to Willis No. 2,320,690, Preininger No. 2,881,614, Nielson No. 3,783,566, and LeGrady No. 4,107,895, such blocks usually require handling by skilled masons as the use of mortar between the block joints and courses is required. In addition, such blocks lack fixed locating and retaining means for precisely and uniformly mounting the blocks on a series of vertical reinforcing rods. Thus, the use of such blocks is more complicated and time consuming than use of the herein building block system about to be described.

SUMMARY OF THE INVENTION

The principal object of the present invention is to provide generally rectangular building blocks of partially hollow construction having generally zig-zag shaped securing rods embedded in the interior walls and extending transversely of and formed with transverse loops in the centers of each hollow interior for precisely and uniformly locating and mounting the blocks in abutting mortarless courses over vertical reinforcing bars anchored in a concrete footing for erecting a mortarless wall construction wherein the hollow interiors of the blocks may or may not be filled with concrete.

Another object is the provision of generally hollow building blocks having zig-zag shaped rods embedded in the interior walls and bent and looped so that transversely arranged loops are disposed in the centers of each hollow interior and are adapted to sleevably receive vertical reinforcing bars therethrough and thereby insure that adjoining blocks and courses are precisely and uniformly located and retained in mortarless abutting relation.

A further object is to provide a poured concrete footing upon which a plastic sheet with a row of pre-punched openings therein is flatly arranged, and a row of spaced reinforcing bars are inserted through the sheet openings and embedded within the footing so as to project vertically therefrom in uniformly spaced relation whereby the looped zig-zag shaped locating and securing rods embedded in the hollow building blocks may be sleeved thereover in courses to erect a mortarless wall construction.

Still another object is the provision of a system of hollow building blocks with fixed looped locating and securing rods embedded in the hollow interiors and sleevably mounted on a series of vertical reinforcing bars anchored in a poured concrete footing to erect a very strong and yet mortarless concrete block construction for use in the heavy construction field wherein concrete may be poured into the interior voids thereof to effect a solid concrete structure, with the blocks acting as forms which become a part thereof.

A still further object is to provide hollow building blocks with fixed looped locating and securing rods embedded therein and sleevably mounted in abutting courses on a series of vertical reinforcing bars anchored in a poured concrete footing which are adapted to be handled and laid in courses by inexperienced personnel to produce a uniformly plumb wall construction.

These and other objects and advantages will be apparent as the specification is considered with the accompanying drawings, wherein FIG. 1 is a perspective view of a partially hollow concrete building block having two vertical openings extending therethrough, and partly in section to show a generally zig-zag locating and securing looped rods embedded in the interior walls thereof and extending through a central rib thereof so as to be disposed within each opening;

Figure 6:
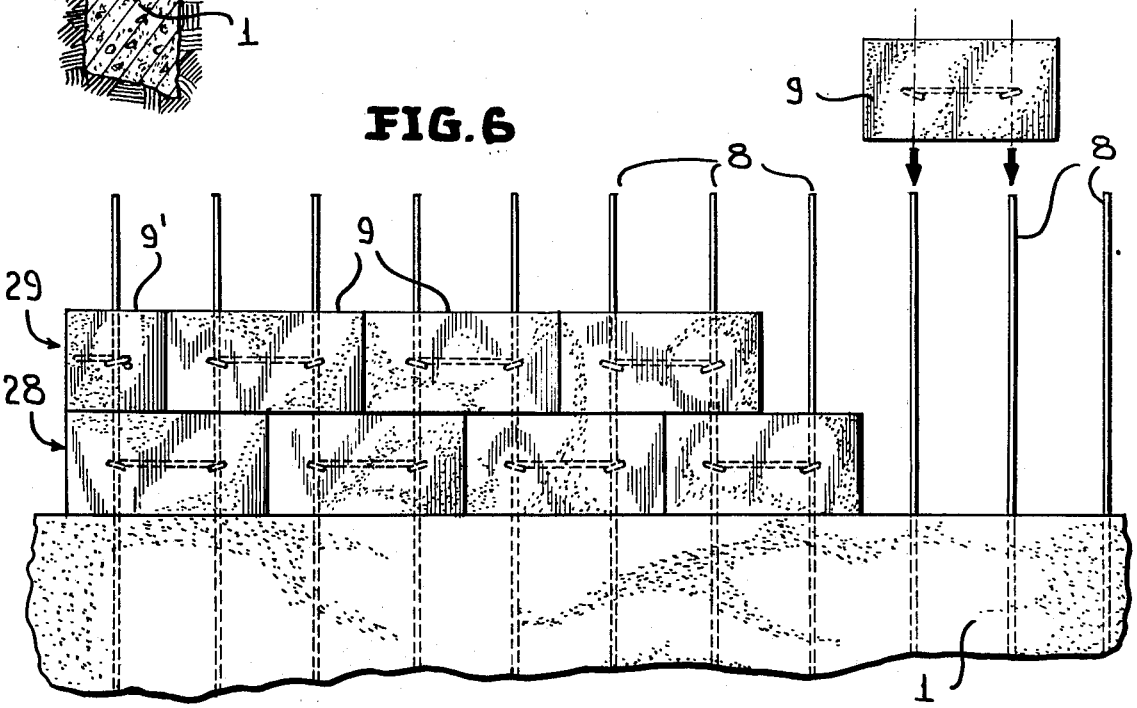
Figure 7:
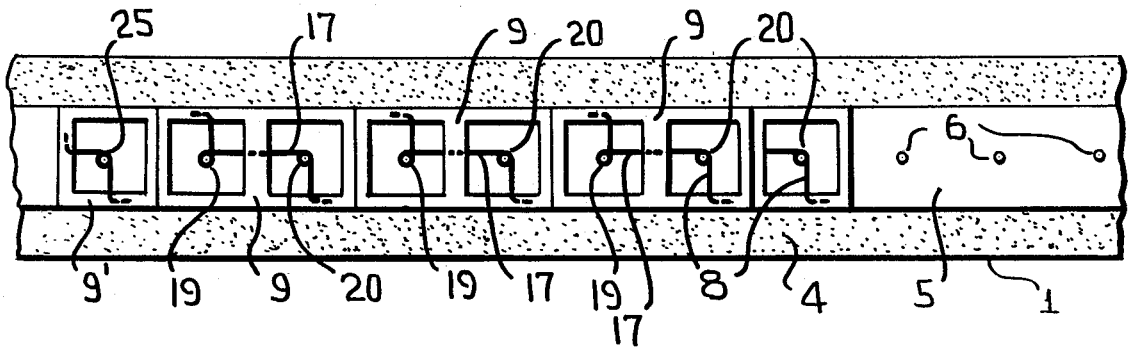

FIG. 6 is an elevational view of a section of poured footing with two courses of building blocks sleeved over the reinforcing bars thereof in abutting mortarless relation, and showing how a block and the locating and securing looped rod thereof is mounted relative to the bars; and FIG. 7 is a plan view of a section of poured footing with plastic pre-punched sheet thereon, reinforcing bars embedded therein, and a row of blocks sleeved thereover in aligned abutting mortarless relation.

DETAILED DESCRIPTION

Figure 5:
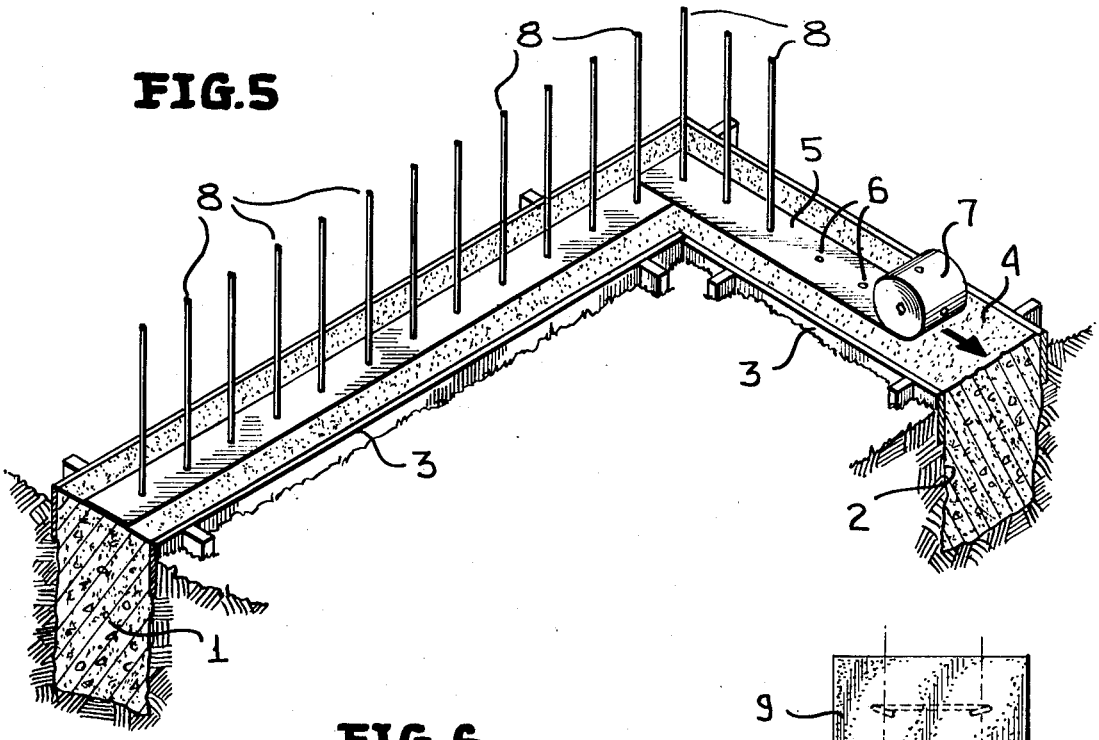
FIG. 5 is a perspective view of a portion of poured concrete footing with lengths of pre-punched plastic sheeting flatly disposed thereon and rows of reinforcing bars inserted through the openings and anchored in the footing so as to project vertically therefrom in uniformly spaced relation.

Referring more particularly to the drawings, wherein similar reference characters designate like parts throughout the several views, and as best shown in FIGS. 5 to 7, numeral 1 identifies a corner section of concrete footing for a wall construction which may be formed in the usual manner by first forming trenches 2 of a suitable depth and pouring concrete between the usual forms 3 therein so as to provide a generally flat horizontally disposed upper face 4. Flatly arranged on and extending longitudinally on the upper face 4 and spaced inwardly of the side edges thereof is a length of suitable relatively thin vinyl plastic sheeting 5 formed with a central row of spaced pre-punched openings 6 therein. Plastic sheet 5 may be in the form of a roll 7 of a width narrower than that of the footing 1 so that a roll 7 may be positioned at one end of the footing while still unset and unrolled so that the sheeting extends throughout that section of footing at which time the sheeting may be detached from the roll.

The pre-punched openings 6 may be uniformly spaced so as to be located in alignment with the centers of the hollow interiors of concrete building blocks, presently to be described and which are laid in courses in abutting relation on footing 1. With the sheeting 5 arranged thereon, the openings 6 thereof serve to locate the positions where a series of elongated metal reinforcing bars 8 are inserted therethrough and embedded in the unset footing. Thus, when the concrete footing sets, the bars 8 will be firmly anchored therein and will project upwardly therefrom in a uniformly spaced row throughout the length of the footing.

As best shown in FIGS. 1–4, a wall is constructed of a plurality of generally rectangular shaped concrete building blocks 9 each having top and bottom surfaces 10–11 joined by two end walls 12 and front and rear walls 13–14. Each block 9 is preferably partially hollow, in the usual manner, to provide large rectangular vertical openings 15 defining the interior surfaces of end walls 12 and the front and rear walls 13–14, respectively, and a central rib 16. It is usually desirable to also use half blocks $9^1$ in the customary manner, as in FIG. 4, formed with a single rectangular vertical opening $15^1$.

Arranged in the vertical openings 15—$15^1$ of both forms of blocks is a securing and locating rod for the reinforcing bars 8 which is of generally zig-zag shape. These securing rods may be suitably arranged in the block forming molds in a conventional block forming machine, not shown, so that they constitute an integral part of each block. First referring to the block of FIGS. 1–3, rod 17 includes an elongated main section 18 extending longitudinally and horizontally through center rib 16 and terminating at either end generally in the center of vertical openings 15, where the rod is twisted into horizontally disposed loops 19–20. Looped end 19 projects laterally and rearwardly, at right angles as at 21, and has as a right angularly bent terminal end 22 so as to be embedded and anchored in a rear wall 14. The other looped end 20 is bent laterally at right angles in an opposing direction, as at 23, and is formed with a laterally bent terminal end 24 embedded and anchored in a front wall 13.

Figure 1:
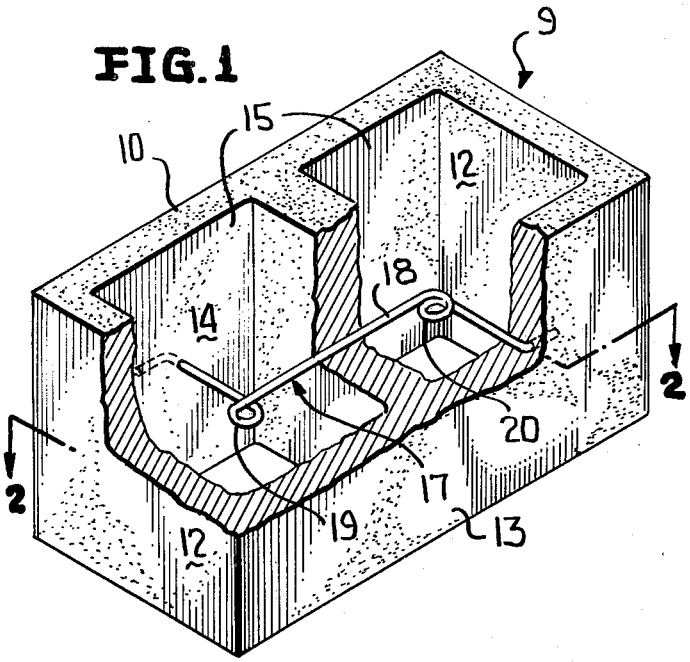
Figure 4:
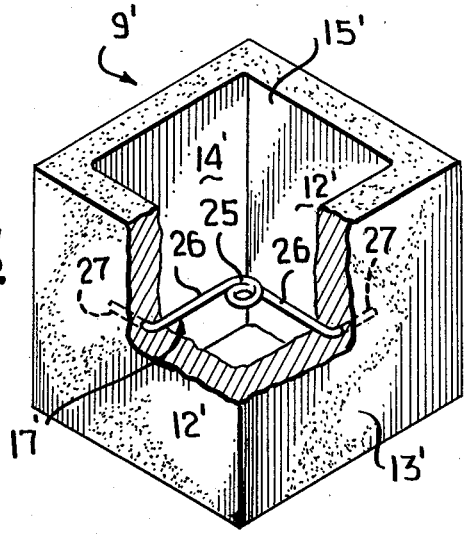
FIG. 4 is a perspective view of a single opening block, partly in section to show how the locating and securing looped rod is arranged therein.
Figure 2:
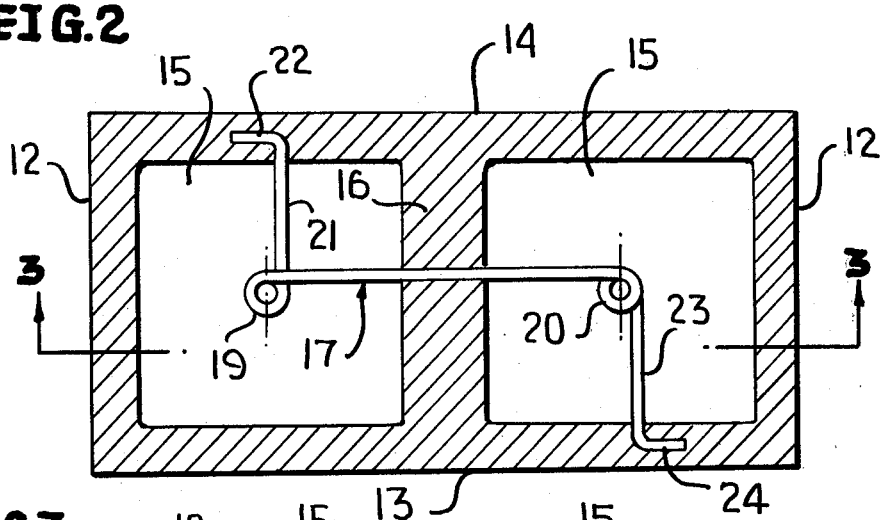
FIG. 2 is a section on the line 2—2 of FIG. 1.
Figure 3:
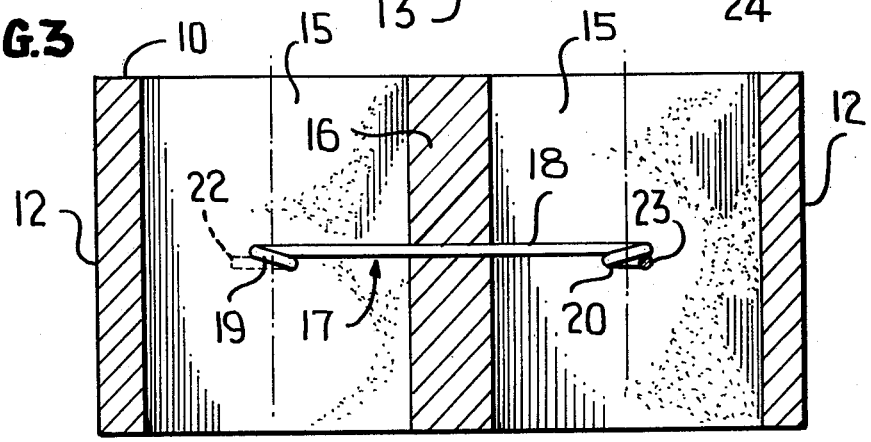
FIG. 3 is a section on the line 3—3 of FIG. 2.

As the half block $9^1$ of FIG. 4 only has a single rectangular vertical opening $15^1$ and lacks a central rib, the retaining and locating wire $17^1$ arranged therein does not require the elongated main section so that the rod is twisted and looped in the center, as at 25. Rod $17^1$ is formed with two legs 26 extending from the loop 25 at right angles which are bent laterally, as at 27, at their ends so as to be embedded in end and side walls $12^1$ and $13^1$. As in the embodiment of FIGS. 1–3, loop 25 of rod $17^1$ is disposed in the center of vertical opening $15^1$, midway of the height thereof.

After the footing 1 has been poured, and the plastic sheeting 5 arranged on the flat upper face 4 thereof, and the vertical reinforcing bar 8 have been inserted through the row of pre-punched uniformly spaced openings 6 and embedded therein, the concrete is permitted to set so that the bars 8 are securely anchored in the footing and project upwardly therefrom in a spaced row of uniform height. As the spacing between the pre-punched openings 6 in the sheet is based on the dimensions of a standard hollow rectangular concrete building block, such as that herein described, the reinforcing bars 8 will be so spaced to be alignable with the securing and locating rod loops 19–20 of rod 17, and the loop of rod $17^1$. Thus, as best illustrated in FIGS. 6–7, the blocks of the first or bottom course 28 are manually arranged above the retaining bars so that the latter are aligned with the looped rods and the blocks are manually moved downwardly thereover whereby a single bar will be sleeved through a centrally positioned loop 25 of a half block $9^1$, and a pair of bars will extend through the dual loops 19–20 of a full sized block 9. Accordingly, the first or bottom course of blocks 28 disposed on the footing will extend in a straight row of abutting end to end blocks, with their front and rear walls in alignment. When the first course 28 has been laid, the second course 29 is laid with the bottom surface 11 of each block 9 thereof resting on the top surface 10 of each block 9 in the first course. As in a conventional wall, the blocks in the second course 29 are staggered from the blocks 9 in the first course 28 with their abutting ends over the center of the blocks 9 in the first course. It is, of course, essential that one of the rectangular openings 15 of each second course block be aligned with and directly over an opening of a block therebelow. This procedure is repeated for all subsequent courses until a wall of the desired height and length has been erected.

With the securing and locating rod of each block sleeved over the reinforcing bars, it will be apparent that the blocks may be laid in end to end and bottom to top relationship in courses by relatively unskilled labor and securely retained thereat without the use of any mortar therebetween. Although such a mortarless concrete block wall is stable and sufficiently strong for general use, in the event use thereof in the heavy construction field, such as when erecting a pier, is required, the strength thereof may be increased by filling the voids of the blocks by pouring concrete thereinto. This, in essence, creates a solid concrete wall structure, with the blocks acting as forms and becoming a part thereof, and eliminates the use of wooden forms and reduces the labor required.

While a preferred embodiment of concrete building block with fixed looped securing rod embedded therein for use with reinforcing bars vertically arranged in a concrete footing for erecting a mortarless wall has been herein shown and described, it is to be understood that various changes and improvements may be made therein without departing from the scope and spirit of the appended claims.

What I claim is:

1. A generally rectangular hollow concrete building block for use in constructing concrete block walls including a concrete footing having a row of uniformly spaced and vertically extending reinforcing bars anchored therein, said block having at least one generally rectangular opening extending vertically therethrough and having flat top, bottom, side and end walls, securing bar retaining and locating means embedded in the interior of said walls and extending transversely into the center of said opening, said bar retaining means having one end fixedly embedded in one wall of opening and extending into the center thereof where it is twisted to form a transversely positioned loop in the center of said opening and its other end fixedly embedded in an adjacent wall, said block being positionable above said reinforcing bars with said opening and said loop alignable therewith and moved downwardly thereover whereby said bars are sleeved through said loops and aligned and retained in end to end abutting relation relative to each other in courses without the use of mortar.

2. A concrete building block according to claim 1, wherein said block is formed with a pair of generally rectangular openings separated by a central rib, and said bar retaining means is embedded in a wall of one opening and extends through said central rib and is embedded in a wall of the other opening, said bar retaining being formed with a transversely positioned loop in the center of each opening.

3. A concrete building block according to claim 2, wherein one end of said bar retaining means is embedded in a wall of one of said openings and projects inwardly into the center of said opening where it is looped and thence extends through said central rib and into said other opening where it is looped in the center thereof and projects laterally and is embedded in a wall of said other opening.

4. A concrete building block according to claim 3, wherein one end of said bar retaining means is embedded in a rear wall of one of said openings and projects inwardly and at right angles therefrom into the center of said opening where it is looped and thence a portion thereof extends longitudinally through said central rib and into the center of the other of said openings where it is looped and projects laterally at right angles therefrom and is embedded in a front wall of said other opening.

5. A concrete building block according to claim 4, wherein said bar retaining means is generally of zig-zag shape, and the terminal ends thereof are bent laterally for anchoring said bar retaining means in said rear and front walls.

* * * * *